United States Patent [19]

Musat

[11] Patent Number: 4,726,214

[45] Date of Patent: Feb. 23, 1988

[54] SHRINK FORMING APPARATUS

[75] Inventor: John P. Musat, Brea, Calif.

[73] Assignee: NI Industries, Inc., Novi, Mich.

[21] Appl. No.: 853,239

[22] Filed: Apr. 17, 1986

[51] Int. Cl.[4] ..... B21D 41/04; B21D 53/30

[52] U.S. Cl. ..... 72/402; 72/452; 29/159.1

[58] Field of Search ..... 72/402, 452, 399, 415, 72/453.01, 456; 29/237, 283.5, 159.01, 159.1

[56] References Cited

U.S. PATENT DOCUMENTS

| | | | |
|---|---|---|---|
| 2,458,587 | 1/1949 | Gogan | 72/402 |
| 3,242,714 | 3/1966 | Savory | 72/456 |
| 3,461,710 | 8/1969 | Luedi et al. . | |
| 3,564,883 | 2/1971 | Koors et al. | 72/453.01 |
| 3,564,898 | 2/1971 | Stettler . | |
| 3,580,043 | 5/1971 | Gollwitzer | 72/402 |
| 3,581,550 | 6/1971 | Waterbury | 72/402 |
| 3,720,088 | 3/1973 | Pauly et al. | 72/402 |
| 3,756,063 | 9/1973 | Roze et al. | 29/159.3 |
| 3,852,991 | 12/1974 | Poggio | 72/456 |
| 4,470,288 | 9/1984 | Takeda et al. | 72/402 |
| 4,472,959 | 9/1984 | Fencl | 72/402 |

FOREIGN PATENT DOCUMENTS

| | | | |
|---|---|---|---|
| 368287 | 3/1932 | United Kingdom | 72/402 |

*Primary Examiner*—Daniel C. Crane

*Attorney, Agent, or Firm*—Harness, Dickey & Pierce

[57] ABSTRACT

There is disclosed a shrink forming apparatus for rounding vehicular wheels and other annular workpieces. The apparatus includes a power actuated shrinker barrel assembly slidably retained for axial movement about the body of the apparatus. Rounding dies are connected to the shrinker barrel assembly for movement in a radial direction and engagement with the workpiece to perform a shrink forming operation. The apparatus further includes means for substantially eliminating the working clearance between the shrinker barrel assembly and the apparatus body during the shrink forming operation.

28 Claims, 5 Drawing Figures

SHRINK FORMING APPARATUS

BACKGROUND AND SUMMARY OF THE INVENTION

The present invention relates generally to an apparatus for shrinking or radial compression forming of metal workpieces, and more particularly to improved shrink forming apparatus for maintaining accurate alignment of the workpiece with respect to its desired center or axis.

Shrink forming apparatus are utilized to decrease the exterior diameter of an annular workpiece. One use of such shrink forming apparatus is to ensure the roundness of assembled vehicular wheels. One type of such wheel rounding shrink forming apparatus or machine is disclosed in Luedi et al., U.S. Pat. No. 3,461,710, and the disclosure therein is incorporated herein by reference.

For vehicular wheels it is essential to insure perfect roundness of the wheel rim and accurate alignment of the rim with respect to the axis of rotation of the wheel. Conventional shrink forming machines include rounding dies that engage the rim of the wheel for rounding the rim and boring tools for accurately locating and forming openings in the wheel spider. It is these openings which determine the axis of rotation of the wheel.

The continuing demands of the vehicle manufacturers for accuracy creates a necessity for achieving the highest possible levels of accuracy in the wheel making art. True roundness of the wheel rim, while highly desirable, is ineffectual unless the entire rim is accurately aligned with respect to the axis of rotation of the wheel by the wheel rounding dies. The axis of the rotation of the wheel is typically defined by a boring spindle which creates either a central hub opening in the wheel center that coacts with an associated portion of the vehicle, or attachment bolt holes that are accurately located within the wheel center. Although the invention is described in connection with a wheel-forming machine, it is fully applicable to machines for forming other types of workpieces.

Prior known shrink forming machines have attempted to provide the desired roundness and alignment by controlling the radial movement of the wheel rounding dies. The movement of these dies is governed by an outer pressure ring or shrinker barrel whose axial travel is controlled by a series of cylindrical guides. A minor clearance along the guide path of the shrinker barrel therefore can cause misalignment and an out-of-roundness condition of the workpiece.

It is therefore one object of this invention to provide an improved shrink forming apparatus that provides positive location of the outer shrinker barrel in its forming position and thereby insures accurate alignment of the machine parts and a very accurately formed workpiece.

It is a further object of this invention to provide a guiding mechanism for the outer shrinker barrel of a shrink forming apparatus that will not be subject to increasing clearances as the components wear through usage which otherwise would reduce the accuracy of the workpiece being formed.

Additional objects and features of the present invention will become apparent from the subsequent description and the appended claims taken in conjunction with the accompanying drawings.

SUMMARY OF THE INVENTION

Figure 1:
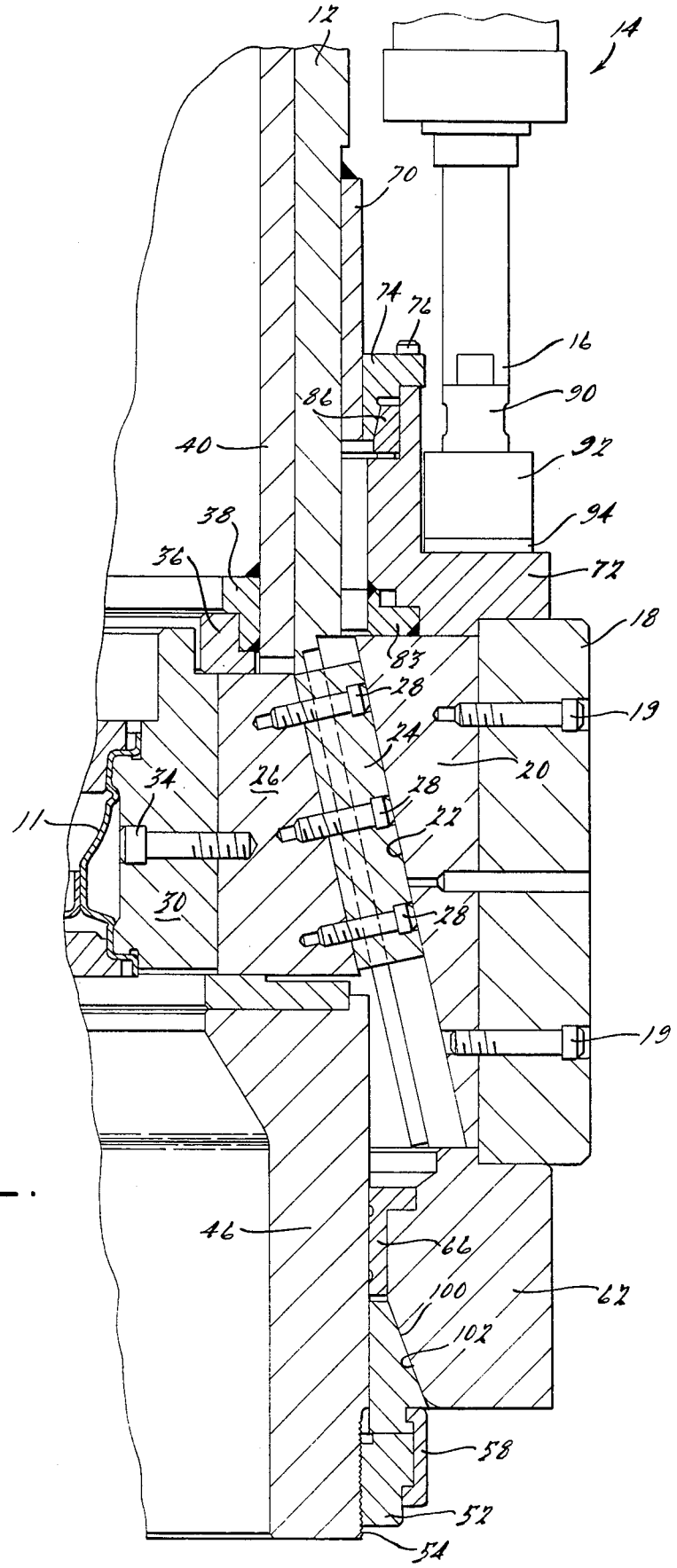
FIG. 1 is a cross sectional view of the shrink forming apparatus of the present invention, showing the apparatus in its rounding and forming position.
Figure 2:
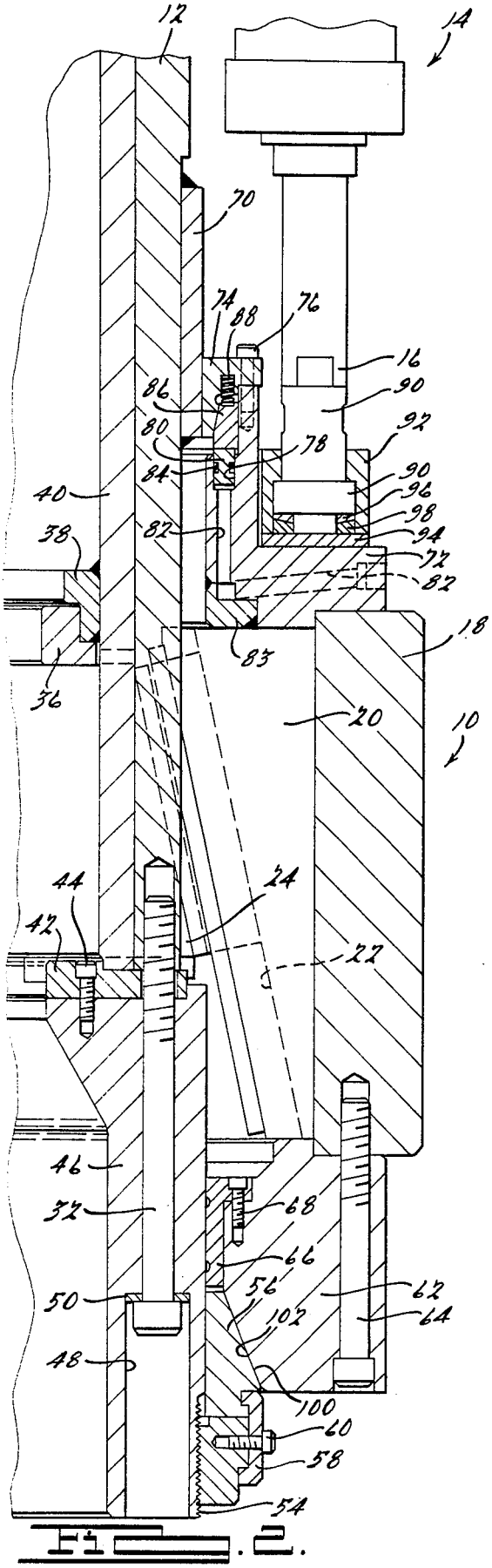
FIG. 2 is a cross sectional view, slightly rotated around the axis of the shrink forming apparatus from FIG. 1, of the shrinker barrel assembly of the shrink forming apparatus in which the shrinker barrel assembly is in a concentrically aligned wheel rounding position.
Figure 3:
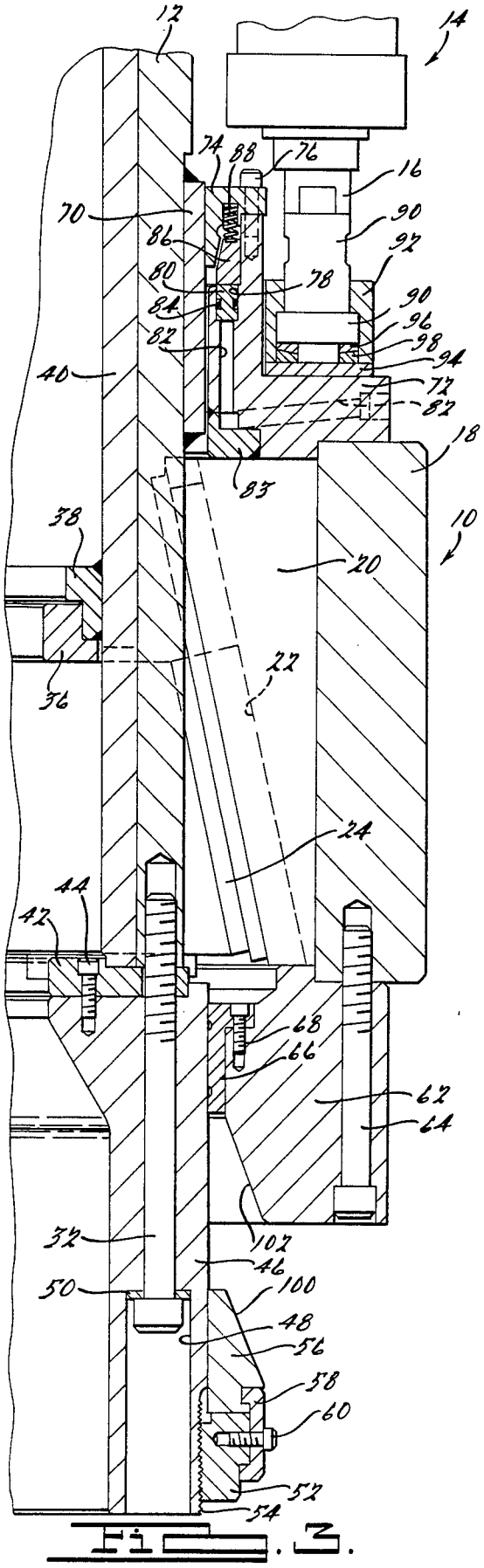
FIG. 3 is a cross sectional view like FIG. 2 in which the shrinker barrel assembly is in a retracted position.

Referring now to the drawings, the shrink forming apparatus of the present invention is shown in FIGS. 1 through 3 at 10. Apparatus 10 includes a fixed sleeve 12 around which a plurality of hydraulic cylinder assemblies 14 are provided. Cylinder assemblies 14 include piston rods 16 that are connected, in a manner more fully described below, to an outer ring or shrinker barrel 18. Shrinker barrel 18 is affixed by means of socket headed screws 19 to a plurality of circumferentially spaced wedge blocks 20. The wedge blocks define T-shaped grooves 22 in which a cooperating jaw retainer 24 is slidably supported. Each jaw retainer 24 is affixed to a respective jaw 26 by socket headed screws 28. Wheel rounding dies 30 which engage a workpiece 11 are affixed to each of the jaws 26 by socket headed screws 34.

Jaws 26 are supported for substantially radial movement between an inner bushing 36 and a lower bushing 42. Inner bushing 36 is attached in any suitable manner to an inner ring 38 which is in turn carried by a fixed inner sleeve 40 of apparatus 10. Lower bushing 42 is affixed by a socket head screw 44 to a lower machine base ring 46. Machine base ring 46 is connected to sleeve 12 by means of a plurality of socket headed bolts 32 which are carried in a cylindrical cutout 48 which is formed in the lower end of base ring 46. A plurality of washers 50 are utilized with socket headed bolts 32 in cutout 48. Socket headed bolts 32 are connected to spacer portions of sleeve 12 that extend between adjacent jaws 26. Sleeve 12, fixed inner sleeve 40, and machine base ring 46 together comprise the body of shrink forming apparatus 10.

An adjustment ring 52 is threaded onto an externally threaded portion 54 formed at the lower end of machine base ring 46. Adjacent adjustment ring 52 is a lower cone 56 which is connected to adjustment ring 52 by a plurality of retainer collars 58 and socket headed bolts 60. Cone 56 is adapted to be engaged by a bearing ring 62 that is affixed to shrinker barrel 18 by socket headed bolts 64. Lower cone 56 limits the extreme downward movement of shrinker barrel 18 and assists in providing positive location of the shrinker barrel. Affixed to the inside of bearing ring 62 is a lower bushing ring 66 that serves as a wear plate for the shrinker barrel assembly as it travels axially along machine base ring 46. Lower bushing ring 66 is connected to bearing ring 62 by a plurality of socket headed bolts 68.

Figure 4:
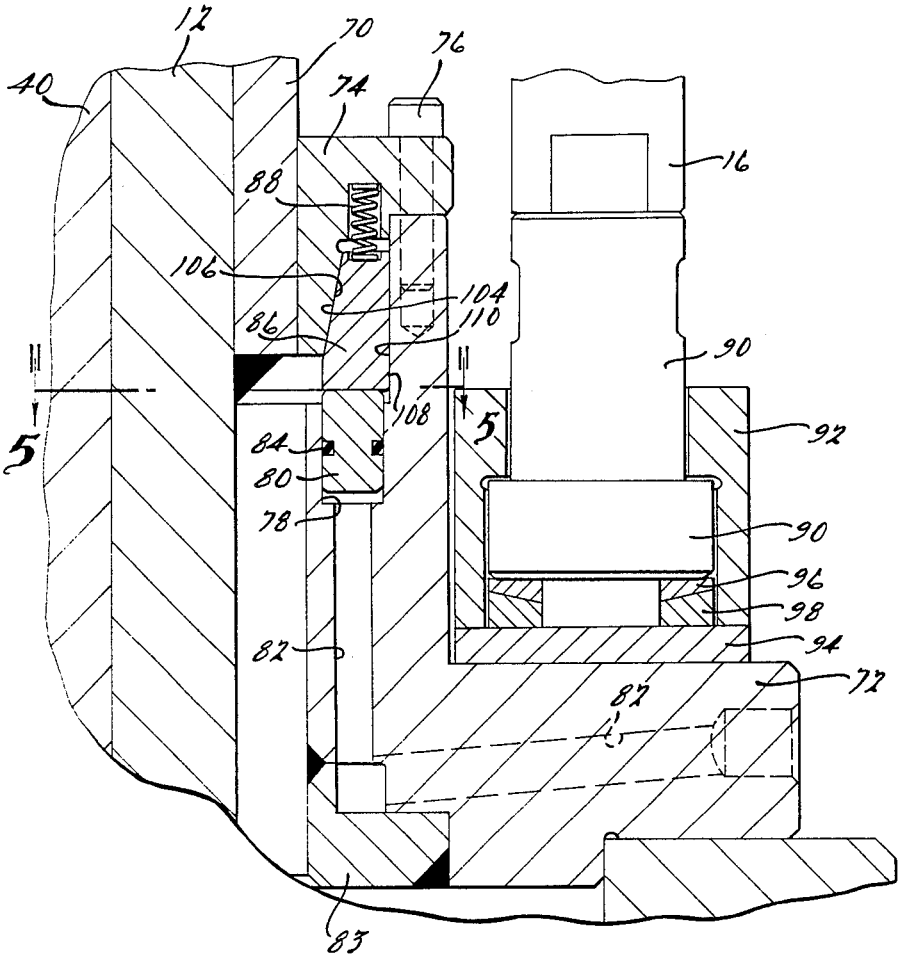
FIG. 4 is an enlarged view showing the upper portion of the shrinker barrel assembly depicted in cross section in FIG. 3.
Figure 5:
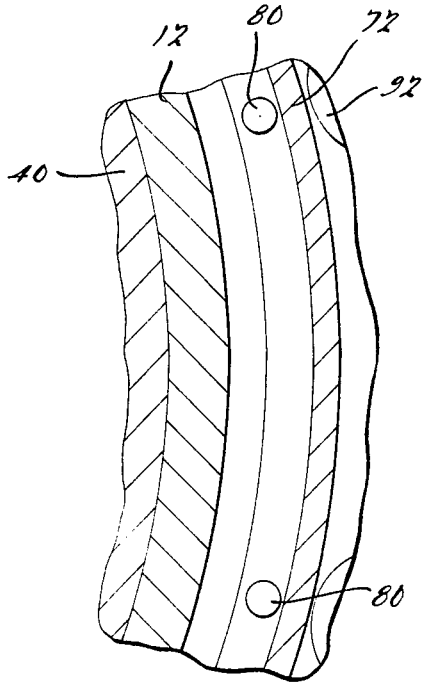
FIG. 5 is a sectional view of the portion of the shrink forming apparatus of the present invention taken along line 5—5 in FIG. 4.

Connected in a suitable fashion to the top of shrinker barrel 46 is an adaptor ring 72 that is generally L-shaped in cross section. At the top of adapter ring 72 is an upper bearing ring 74 that is connected to adapter ring 72 by a plurality of socket headed bolts 76. As shown in FIGS. 4 and 5, adaptor ring 72 has a plurality of cylindrical cutouts 78 that are each fitted with a piston 80 adapted for axial movement within cutout 78. Piston 80 is actuated by fluid pressure that communicates with piston 80 through a fluid passageway 82 provided within adaptor ring 72. A closure ring 83 is provided and affixed to adaptor ring 72 to complete passageway 82 during manufacture. Pistons 80 are each provided with a piston seal 84 to prevent leakage of the piston fluid and attendant loss of pressure.

Pistons 80 are configured to provide a force against an upper cone 86 that is adjacent pistons 80 and situated between adaptor ring 72 and upper bearing ring 74. Located between upper cone 86 and upper bearing ring 74 is a plurality of die springs 88 that urge upper cone 86 and pistons 80 into a retracted position when the wheel rounding operation is completed.

Piston rods 16 of hydraulic cylinder assemblies 14 each bear on a rod end cap 90 which is contained within a block 92. Each rod end cap 90 transfers the axial force from cylinder assemblies 14 through a spacer 94 to adaptor ring 72 and shrinker barrel 18. Situated between each rod end cap 90 and spacer 94 is a pair of spherical washer pads 96 and 98 that insure hydraulic cylinder assemblies 14 will only exert an axial force and not prevent the shrinker barrel assembly from undergoing the necessary float required during the shrink forming operation.

In operation, a vehicular wheel or other appropriate workpiece that is slightly oversize, e.g. the diameter of the tire heads of the rim being slightly larger than the desired finished diameter, is placed on a table that is elevated into the center of rounding dies 30 of shrink forming apparatus 10. At this time rounding dies 30 and shrinker barrel 18 will be in their retracted position as shown in FIG. 3 and cooperating jaw retainers 24 will be at the lower end of T-shaped grooves 22. When the wheel is presented between the open rounding dies 30, hydraulic cylinder assemblies 14 are actuated driving piston rods 16 downwardly. This downward movement is transmitted through adaptor ring 72 to shrinker barrel 18 and wedge blocks 20. Since cooperating jaw retainers 24 and jaws 26 are held against any axial movement, these elements are cammed in a radially inward direction. Wheel rounding dies 30 are formed with appropriate surfaces to engage the outer portion of the wheel rim as the dies 30 move inwardly. The surfaces of dies 30 are accurately designed and formed so as to reduce the diameter of the rim sufficiently so that the rim will be accurately rounded both axially and radially.

As the shrinker barrel assembly, including shrinker barrel 18, and bearing and adaptor rings 62 and 72, respectively, move axially in cooperation with piston rods 16, the upper portion of the shrinker barrel assembly is guided by a guide ring 70 that is connected by any suitable means to the outside of fixed sleeve 12. The lower portion of the shrinker barrel assembly is also guided by lower machine base ring 46 which is attached to fixed sleeve 12. In order for such axial movement of the shrinker barrel assembly to take place, there are working clearances or gaps between the shrinker barrel assembly and guide ring 70 of fixed sleeve 12 and also between the shrinker barrel assembly and base ring 46. Because of these clearances there is a possibility that the wheel rim or other workpiece will not be completely trued during the shrink forming operation. Therefore, lower and upper cones 56 and 86 are disposed at lower and upper ends of the shrinker barrel assembly to provide positive location, and hence assure alignment of, the shrinker barrel assembly with respect to the body of shrink forming apparatus 10.

Lower cone 56 has a normal clearance of approximately 0.006 to 0.008 of an inch between itself and base ring 46. Lower cone 56 has a radially outward face 100 that angles outwardly and downwardly from the top of lower cone 56 and which corresponds to an angled face 102 on the inside of bearing ring 62. Faces 100 and 102 are configured to comprise the smallest included angle that will avoid locking when bearing ring 62 engages lower cone 56.

As the shrinker barrel assembly travels axially downward, angled face 102 of bearing ring 62 engages outward face 100 of lower cone 56 and does not lock thereon but instead causes cone 56 to shrink within its elastic limit with a resultant zero clearance between cone 56 and base ring 46. In this manner bearing ring 62, and hence the lower portion of the shrinker barrel assembly, are positively located with respect to base ring 46.

As the upper portion of the shrinker barrel assembly is moved axially with respect to guide ring 70, there is a similar nominal clearance between upper bearing ring 74 and guide ring 70 to facilitate such movement. As will be described below, this clearance is also virtually eliminated by the present invention during the actual shrink forming of the workpiece.

After the shrinker barrel assembly reaches the downward limit of its axial travel, upper cone 86 is moved upwardly by pistons 80 until upper cone 86 engages upper bearing ring 74. As shown in FIG. 4, upper cone 86 has a radially inward face 104 that angles radially inwardly and downwardly from the top of cone 86. Inward face 104 of cone 86 corresponds to a tapered face 106 of upper bearing ring 74. Faces 104 and 106, like faces 100 and 102, are configured to comprise the smallest included angle that will avoid locking when upper cone 86 engages upper bearing ring 74. Cone 86 has a radially outward surface 108 that is vertical in nature and lies adjacent to an upper cone surface 110 of adaptor ring 72 that is also vertical in nature.

Consequently, as cone 86 is moved axially upward by pistons 80, it initially wedges between tapered face 106 of bearing ring 74 and upper cone surface 110 of adaptor ring 72 thereby causing any clearance between outward surface 108 of upper cone 86 and upper cone surface 110 of adaptor ring 72 to be eliminated. Further upward movement of cone 86 causes upper bearing ring 74 to shrink within its elastic limit until the clearance between bearing 74 and guide ring 70 is virtually reduced to zero. In this manner bearing ring 74, and hence the upper portion of the shrinker barrel assembly, is positively located with respect to guide ring 70 and fixed sleeve 12 and therefore accurately aligned with the body of shrink forming apparatus 10. Accordingly, the entire shrinker barrel assembly of the present invention is positively, located in an accurate relationship with respect to the rest of shrink forming apparatus 10.

In any apparatus with moving parts, wear developes on such parts through usage. In conventional shrink forming aparatus, such wear only serves to increase the potential lack of alignment of the forming dies with respect to the rest of the apparatus that is already inherent with the built in clearances that are necessary for operation of the shrinker barrel assembly. In the present invention the effects of wear that develop through usage are compensated for by the nonlocking angled faces of upper and lower cones 86 and 56 and their respective corresponding angled mating surfaces of upper and lower bearing rings 74 and 62. For example, as wear developes between bearing ring 62 and lower cone 56, it may be compensated for without affecting the axial distance traveled by the shrinker barrel assembly by loosening retainer collars 58 and turning threaded adjustment ring 52 in the appropriate direction to move lower cone 56 upwardly along base ring 46 until compensation for the effects of wear is made. The adjustment is completed by tightening collars 58 with socket headed bolts 60.

As wear developes between tapered face 106 of upper bearing ring 74 and inward face 104 of upper cone 86 and/or between upper cone surface 110 of adaptor ring 72 and radially outward surface 108 of upper cone 86, it is automatically compensated for by the operation of pistons 80. Pistons 80 are actuated by hydraulic pressure through fluid passageway 82. The hydraulic fluid causes pistons 80 to travel axially upwardly within cylindrical cutout 78 with piston seal 84 serving to prevent leakage of hydraulic fluid and attendant loss of pressure. Pistons 80 press upper cone upward between upper bearing ring 74 and adaptor ring 72 until a predetermined amount of resistance is reached regardless of wear that has occurred. Die springs 88 are situated above upper core 86 in a spring cutout 112 which is located in bearing ring 74 between radially outward face 108 and socket headed bolts 76. The number and alignment of die springs 88 correspond with pistons 80. Die springs 88 fit within a channel 114 that is provided in the top of upper cone 86 and serve to retract upper cone 86 and pistons 80 when the shrink forming process is completed so that the shrinker barrel assembly can be raised to extract wheel rounding dies 30 and remove the wheel or other workpiece.

As shown in FIG. 4, there is a clearance provided between the inside of block 92 and rod end cap 90, and between block 92 and spherical washer pads 96 and 98. This clearance is necessary and works in conjunction with spherical washer pads 96 and 98, to provide the shrinker barrel assembly a degree of radial float so that it will not be impeded in achieving accurate alignment with respect to the rest of shrink forming apparatus 10. The spherical surface between pads 96 and 98 allows the pistons of hydraulic cylinder assemblies 14 to exert purely an axial force on the shrinker barrel assembly. In this manner hydraulic cylinder assemblies 14 will not prevent the necessary radial float of the shrinker barrel assembly within the aforementioned clearance that is provided by block 92 when the shrinker barrel assembly of the present invention is brought into positive alignment with the desired axis of the workpiece.

After the wheel has been rounded and a hub opening has been machined in the wheel spider by a cutting tool on the boring spindle (not shown), the cutting tool is retracted and the pressure on pistons 80 released. Subsequently the wheel rounding dies 30 are retracted by withdrawal of the shrinker barrel assembly and the rounded wheel is then removed from shrink forming apparatus 10.

Thus, there is described and shown in the above description, background, and drawings an improved shrink forming apparatus which fully and effectively accomplishes the objectives thereof. However, it will be apparent that variations and modifications of the disclosed embodiment may be made without departing from the principles of the invention or the scope of the appended claims.

It is claimed:

1. A shrink forming apparatus including a body, a plurality of rounding dies supported by said body for movement in a substantially radial direction with respect to an associated workpiece, a shrinker barrel assembly slidably retained for axial movement about said body and connected to said rounding dies for radially actuating same, there being a given amount of initial working clearance between said shrinker barrel assembly and said body prior to actuation of said rounding dies, power actuator means for axially moving said shrinker barrel assembly with respect to said body in a direction causing said rounding dies to move inwardly to shrink form said workpiece, and means for reducing said working clearance between said shrinker barrel assembly and said body of said apparatus during said shrink forming operation.

2. A shrink forming apparatus as described in claim 1, wherein said clearance reducing means comprises a cone attached to said body, said cone having an inclined surface engageable by a correspondingly inclined surface of said shrinker barrel assembly during said shrink forming operation, whereby clearance between said shrinker barrel assembly and said cone, and between said cone and said body, is substantially eliminated.

3. A shrink forming apparatus as described in claim 2, wherein said inclined surfaces comprise the smallest included angle of inclination that will not lock when said inclined surfaces engage, whereby upon further axial movement of said shrinker barrel assembly, said cone will be caused to shrink within its elastic limit.

4. A shrink forming apparatus as described in claim 2, further comprising adjustment means, said means including an adjustment ring threaded onto an externally threaded portion of said body adjacent said cone and a collar connecting said cone to said adjustment ring, whereby said adjustment ring can be turned relative to said threaded portion to control the axial position of said cone with respect to said body.

5. A shrink forming apparatus as described in claim 1, wherein said clearance reducing means comprises a cone carried within said shrinker barrel assembly, said cone having an inclined surface and an opposite vertical surface and being actuated into axial movement during said shrink forming operation by an actuating means to wedge between a correspondingly inclined surface and an opposite vertical surface of said shrinker barrel assembly, said correspondingly inclined surface being carried by a bearing member of said shrinker barrel assembly that bears against a wearing surface of said body during axial movement of said shrinker barrel assembly, whereby clearance between said bearing member and said wearing surface, and between said cone and said vertical surface, is substantially eliminated.

6. A shrink forming apparatus as described in claim 5, wherein said inclined surfaces comprise the smallest included angle of inclination that will not lock when said inclined surfaces engage, whereby upon further axial movement of said cone, said bearing member will be caused to shrink within its elastic limit.

7. A shrink forming apparatus as described in claim 5, whereby said actuating means is a plurality of pistons, each of said pistons being carried in a cylindrical cutout in said shrinker barrel assembly.

8. A shrink forming apparatus as described in claim 7, wherein said pistons each include a piston seal to prevent pressurized fluid from leaking between said piston and said cylindrical cutout.

9. A shrink forming apparatus as described in claim 8, wherein said clearance eliminating means further comprises a plurality of die springs located between said shrinker barrel assembly and said actuating means, whereby when said wheel forming operation is completed said springs urge said cone into a retracted position so that said shrinker barrel assembly can be retracted and said workpiece can be removed from said apparatus.

10. A shrink forming apparatus as described in claim 1, wherein said power actuator means comprises a plurality of hydraulic cylinder assemblies having pistons, said pistons collectively engaging an adaptor ring of said shrinker barrel assembly.

11. A shrink forming apparatus as described in claim 10, wherein said power actuator means further comprises a pair of spherical washer pads located between each said piston of said hydraulic cylinder assemblies and said adaptor ring, whereby said pads allow said shrinker barrel assembly to radially float during said clearance reduction.

12. A shrink forming apparatus for rounding workpieces, said apparatus comprising:

a plurality of rounding dies, means for supporting said rounding dies for movement in a substantially radial direction with respect to an associated workpiece, actuating means for moving said dies radially inwardly from a retracted position wherein said workpiece may be juxtaposed to said rounding dies, to a rounding position wherein said rounding dies are adapted to engage and perform a rounding operation upon said workpiece, said actuating means having an initial amount of working clearance, and means for providing accurate concentricity of said dies by reducing said working clearance in said actuating means during said shrink forming operation.

13. A shrink forming apparatus as described in claim 12, wherein said actuating means includes a shrinker barrel assembly slidably retained for axial movement about said supporting means and connected to said rounding dies, and power actuator means for axially moving said shrinker barrel assembly in a direction causing said rounding dies to move radially inwardly.

14. A shrink forming apparatus as described in claim 13, wherein said providing means comprises a lower cone attached to said supporting means and having an outer inclined surface that tapers outwardly away from said shrinker barrel assembly, said shrinker barrel assembly having a correspondingly inclined surface near its lower portion that is brought to bear against said inclined surface of said cone when said shrinker barrel assembly undergoes axial movement during said wheel rounding operation, and an upper cone carried within an upper portion of said shrinker barrel assembly, said upper cone having a sloped surface and being actuated during said shrink forming operation by a plurality of first pistons to wedge between a correspondingly sloped surface and a vertical surface of said shrinker barrel assembly, said correspondingly sloped surface being carried by a bearing member of said shrinker barrel assembly that contacts a wearing surface of said supporting means during axial movement of said shrinker barrel assembly, whereby working clearance between said lower cone and said supporting means and between said bearing member and said wearing surface is substantially eliminated.

15. A shrink forming apparatus as described in claim 14, wherein said inclined surfaces and said sloped surfaces comprise the smallest included angle of inclination that will not lock when said surfaces engage.

16. A shrink forming apparatus as described in claim 15, wherein after said inclined surfaces engage, further axial movement of said shrinker barrel assembly will cause said lower cone to shrink within its elastic limit.

17. A shrinker barrel assembly as described in claim 15, wherein after said sloped surfaces engage, further axial movement of said upper cone will cause said bearing member to shrink within its elastic limit.

18. A shrinker barrel assembly as described in claim 14, further comprising adjustment means for compensating for wear between said inclined surfaces, said means comprising an adjustment ring threaded onto an externally threaded portion of said supporting means adjacent said lower cone and a collar connecting said lower cone to said adjustment ring, whereby said adjustment ring can be turned relative to said threaded portion to control the axial position of said lower cone with respect to said supporting means.

19. A shrinker barrel assembly as described in claim 14, wherein each of said first pistons is carried in a cylindrical cutout in said shrinker barrel assembly and is activated by fluid pressure, said cutout being connected to a fluid source through a fluid passageway carried in said shrinker barrel assembly.

20. A shrinker barrel assembly as described in claim 19, wherein said first pistons each include a piston seal to prevent said pressurized fluid from leaking between said first piston and said cylindrical cutout.

21. A shrinker barrel assembly as described in claim 20, wherein said providing means further comprises a plurality of die springs, each said die spring being located between said shrinker barrel assembly and said upper cone above said first piston, whereby when said fluid pressure is reduced after said wheel forming operation is completed said springs urge said upper cone and said first pistons into a retracted position allowing said shrinker barrel assembly to be retracted by said power actuator means and said wheel to be removed from said apparatus.

22. A shrink barrel assembly as described in claim 13, wherein said power actuator means comprises a plurality of hydraulic cylinder assemblies having second pistons, said second pistons collectively engaging an adaptor ring of said shrinker barrel assembly.

23. A shrinker barrel assembly as described in claim 22, wherein said power actuator means further comprises a pair of spherical washer pads located between each said second piston of said hydraulic cylinder assemblies and said adaptor ring, whereby said pads allow said shrinker barrel assembly to radially float during said clearance elimination.

24. A shrink forming apparatus as claimed in claim 1, wherein said power actuator means comprises motor means and spherical pads disposed between said motor means and said shrinker barrel assembly to permit the latter to float radially during said clearance reduction.

25. A shrink forming apparatus as claimed in claim 1, wherein said working clearance is reduced to zero during said shrink forming operation.

26. A shrink forming apparatus as claimed in claim 1, wherein the working clearace reduced is disposed adjacent the leading end of said shrinker barrel assembly as it moves axially with respect to said body during said shrink forming operation.

27. A shrink forming apparatus as claimed in claim 26, further comprising additional means for reducing the working clearance between said body and the trailing end of said shrinker barrel assembly as the latter moves axially with respect to said body during said shrink forming operation.

28. A shrink forming apparatus as claimed in claim 2. further comprising adjusting means for adjusting the position of said cone relative to said body.

* * * * *